US007118270B2

(12) United States Patent
Hiranuma et al.

(10) Patent No.: US 7,118,270 B2
(45) Date of Patent: Oct. 10, 2006

(54) PORTABLE WATCH

(75) Inventors: Haruki Hiranuma, Chiba (JP); Hisamitsu Yoshikawa, Chiba (JP)

(73) Assignee: Seiko Instruments Inc., (JP)

( * ) Notice: Subject to any disclaimer, the term of this patent is extended or adjusted under 35 U.S.C. 154(b) by 257 days.

(21) Appl. No.: 10/784,424

(22) Filed: Feb. 23, 2004

(65) Prior Publication Data

US 2005/0013203 A1 Jan. 20, 2005

(51) Int. Cl.
*G04B 37/00* (2006.01)

(52) U.S. Cl. ..... 368/289; 368/288; 368/308; 368/319

(58) Field of Classification Search ..... 368/206, 368/190, 204, 216, 288–290, 319–321
See application file for complete search history.

(56) References Cited

U.S. PATENT DOCUMENTS 2,399,119 A * 4/1946 Howell ..... 411/530
2,476,617 A * 7/1949 Mueller ..... 403/9
4,308,665 A * 1/1982 Losch ..... 33/781
5,576,496 A * 11/1996 Carlini et al. ..... 73/460
5,882,044 A * 3/1999 Sloane ..... 285/92

FOREIGN PATENT DOCUMENTS

JP 57046181 * 3/1982

* cited by examiner

*Primary Examiner*—Randy W. Gibson
*Assistant Examiner*—Sean Kayes
(74) *Attorney, Agent, or Firm*—Adams & Wilks

(57) ABSTRACT

A portable watch comprises a case body having a noncircular pipe-attachment hole extending therethrough, and a winding stem pipe removably inserted from outside of the case body into the pipe-attachment hole and having a noncircular outer peripheral portion that cooperates with the noncircular pipe-attachment hole to prevent relative rotation between the case body and the winding stem pipe. An inner end portion of the winding stem pipe extends beyond the inside surface of the case body into the interior of the case body and an outer end portion of the winding stem pipe extends out from the exterior of the case body, the outer end portion having a male screw section and the inner end portion having an annular groove around the outer periphery thereof. A stopper removably engaged with the annular groove abuts with an interior surface of the case body to prevent withdrawal of the winding stem pipe from the pipe-attachment hole and is disengageable from the annular groove to permit withdrawal of the winding stem pipe from the pipe-attachment hole. A crown has a female screw section screwed together with the male screw section to removably connect the crown to the winding stem pipe.

13 Claims, 4 Drawing Sheets

PORTABLE WATCH

BACKGROUND OF THE INVENTION

1. Field of the Invention

The present invention relates to a portable watch in which, structurally, a crown is so retained as not to accidentally rotate.

2. Description of the Prior Art

In a portable watch exemplified by a divers watch, adopted is the structure in which a crown is locked utilizing screw engagement (such a structure is referred to as screw lock in this specification) to prevent the crown from accidentally rotating when the portable watch is carried around.

The screw lock structure is a structure in which a case band including a watch movement is attached with a winding stem pipe, and to a male screw section formed at the outer rim of an extracase-band end section of the pipe, and a female screw section located at a crown main section and screwed to the male screw section of the extracase-band end section. With such a structure, under normal circumstances, the crown main section is screwed into the outer rim of the extracase-band end section so that the crown is locked. In order to operate the watch movement, the crown main section is unscrewed from the male screw section, and after pulling out the crown, a winding stem located inside of the winding stem pipe can be operated for rotation.

With the conventional portable watch of such a screw lock structure, generally, a winding-stem-pipe-attachment section can be waterproof by brazing the winding stem pipe to the case band (see JP-A-57-46181 (from 8th line, right column, page 1 to 7th line, left column, page 2, FIGS. 1 and 2) as an example).

Other than the above, also known is another portable watch of a type aiming for waterproof capability of the winding-stem-pipe-attachment section. Therein, in the middle part of the winding stem pipe in the axial direction, a male screw section is provided separately from another male screw section to which a crown is screwed together so that the male screw section is screwed into the pipe-attachment hole of the case band, and after this screwing is completed, a waterproof gasket is sandwiched between the case band and the winding stem pipe.

In a portable watch with the screw lock structure, repeatedly operating the crown for rotation will cause both the screwed-together female screw section of the crown and the male screw section of the winding stem pipe to be worn out or chipped, resultantly reducing the screw lock capability.

In such a case, the portable watch of JP-A-57-46181 in which the case band is brazed with the winding stem pipe does not allow exchange of components located close to the crown if removal of the winding stem pipe from the case band is required. There is thus no choice to exchange the watch exterior assembly including the case band. As such, there has been a demand for improvement thereof.

With a watch having a winding stem pipe screwed into a case band, it has been considered that, in principle, exchange is possible for components including the winding stem pipe, located close to the crown. Even with such a structure, however, the winding stem pipe receives rotation forces every time the crown is screwed into the winding stem pipe or every time this screwing is unscrewed. Accordingly, the screwing of the winding stem pipe into the case band becomes loose, resultantly possibly causing the waterproof capability achieved by a waterproof gasket to be reduced.

As measures against that, adhesive filling is sometimes done to the section at where the winding stem pipe and the case band are screwed together. If adhesive is used for attachment as such, the winding stem pipe becomes difficult to be removed from the case band, and in a practical sense, exchange of components located close to the crown becomes impossible. As a result, there has been no choice to exchange the watch exterior assembly including the case band if the screw lock capability is reduced. As such, there has been a demand for improvement thereof.

An object to be achieved by the present invention is to provide a portable watch capable of exchange of components located close to the crown when the screw lock capability is reduced.

SUMMARY OF THE INVENTION

In order to achieve the above object, the present invention is characterized in that, a case band is provided with a pipe-attachment hole opening toward both an intracase-band plane and an extracase-band plane, and a pin-receiving groove opening toward the pipe-attachment hole and also toward at least either the intracase-band plane or the extracase-band plane. A winding stem pipe is playably inserted into the pipe-attachment hole in a removable manner from outside of the case band. And this winding stem pipe is so structured as to include an insertion section including an intracase-band end section with an engagement groove to be arranged inside of the case band, an extracase-band end section including a male screw section to be screwed together with a crown in a removable manner for arrangement outside of the case band, and another pin-receiving groove opening toward an outer rim plane of the insertion section and facing to the above-described pin-receiving groove. Further, a rotation-stop pin is arranged across both of the pin-receiving grooves of the case band and the winding stem pipe to prevent the winding stem pipe from rotating, and a pipe stopper is engaged with the engagement groove provided to the intracase-band end section in a removable manner to prevent the winding stem pipe from being disengaged.

In the present invention, the case band and the winding stem pipe can be preferably made with metal exemplified by materials such as stainless steel. However, this is not restrictive, and these parts may be made of synthetic resin. In the present invention, the expression of the winding stem pipe being "playably inserted" into the pipe-attachment hole denotes the insertion state that the winding stem pipe is not press-fit but is inserted into the pipe-attachment hole without fixation, and the insertion section is allowed to be inserted or removed to/from the attachment hole from the extracase-band side. Under this insertion state, providing a slight gap (play) between the winding stem pipe and the pipe-attachment hole is considered preferable. However, substantially, there may be no need for this gap. In the present invention, the pipe stopper may be substituted by a C-shaped or E-shaped stopper or an annular nut capable of functioning as a stopper component on its own, and the like. Other than those, it is also possible to use, as a stopper, a board section with a U-shaped groove in a piece formed to an inner frame made of synthetic resin and others arranged in the intracase-band side (inner space of the case band) for the purpose of supporting a watch movement. If this is the case, the board section can be caused to function as a pipe stopper by fitting the U-shaped groove into the engagement groove of the intracase-band end section of the winding stem pipe. Moreover, depending on the type of the pipe stopper, the engagement groove of the intracase-band end section can be formed by an annular groove or a screw groove.

In the present invention, the winding stem pipe playably inserted into the pipe-attachment hole of the case band is fixed to the case band not to rotate by the rotation-stop pin, which engages both the winding stem pipe and the case band. At the same time, it is prevented from being disengaged on the extracase-band side by the pipe stopper located in the intracase-band side. That is, the winding stem pipe is attached to the case band without fixation. As such, in the respect of maintenance, with the pipe stopper removed, the winding stem pipe playably inserted into the pipe-attachment hole can be pulled out to the extracase-band side.

In a preferable embodiment of the present invention, the pin-receiving groove of the case band is made open toward the intracase-band plane, and the pin-receiving groove of the winding stem pipe is made open toward the tip plane of the insertion section. Therefore, it is considered superior in the respect that the rotation-stop pin can be inserted or removed to/from the intracase-band side without being disturbed by the extracase-band end section of the winding stem pipe.

In the preferable embodiment of the present invention, the rotation-stop pin is sandwiched, in an axial direction, between a groove end of the pin-receiving groove of the winding stem pipe located closer to the extracase-band end section and the pipe stopper. Accordingly, it is considered superior in the respect that, in order not to disengage the rotation-stop pin and to retain it at any predetermined position, there is no need to include a component specifically designed therefor.

Moreover, in order to achieve the above object, the present invention provides a case band with a noncircular pipe-attachment hole opening toward an intracase-band plane and an extracase-band plane. Therein, provided are an insertion section having playably inserted, to the pipe-attachment hole from outside of the case band, a winding stem pipe having an outer rim being noncircular in shape corresponding to the pipe-attachment hole, and including an intracase-band end section with an engagement groove to be arranged inside of the case band; and an extracase-band end section including a male screw section to be screwed together with a crown in a removable manner. Further, a pipe stopper is engaged with the engagement groove provided in the intracase-band end section in a removable manner to prevent the winding stem pipe from being disengaged.

In the present invention, the outer rim plane of the winding stem pipe being noncircular in shape includes the shape formed with one or more groove threads or convex threads extending to the outer rim plane of the winding stem pipe in the axial direction, or a polygon. Similarly, the pipe-attachment hole to be playably inserted with the winding stem pipe being noncircular in shape includes the shape formed with one or more convex threads or groove threads extending to the inner rim plane of the pipe-attachment hole in the axial direction, or a polygon.

In the present invention, the winding stem pipe playably inserted into the pipe-attachment hole of the case band is fixed to the case band not to rotate by the fact that the pipe and the pipe-attachment hole both being noncircular in shape. At the same time, it is prevented from being disengaged on the extracase-band side by the pipe stopper located on the intracase-band side. That is, the winding stem pipe is attached to the case band without fixation. As such, in the respect of maintenance, with the pipe stopper removed, the winding stem pipe playably inserted into the pipe-attachment hole can be pulled out to the extracase-band side.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

In the below, described is a first embodiment of the present invention by referring to FIGS. 1 to 3.

Figure 1:
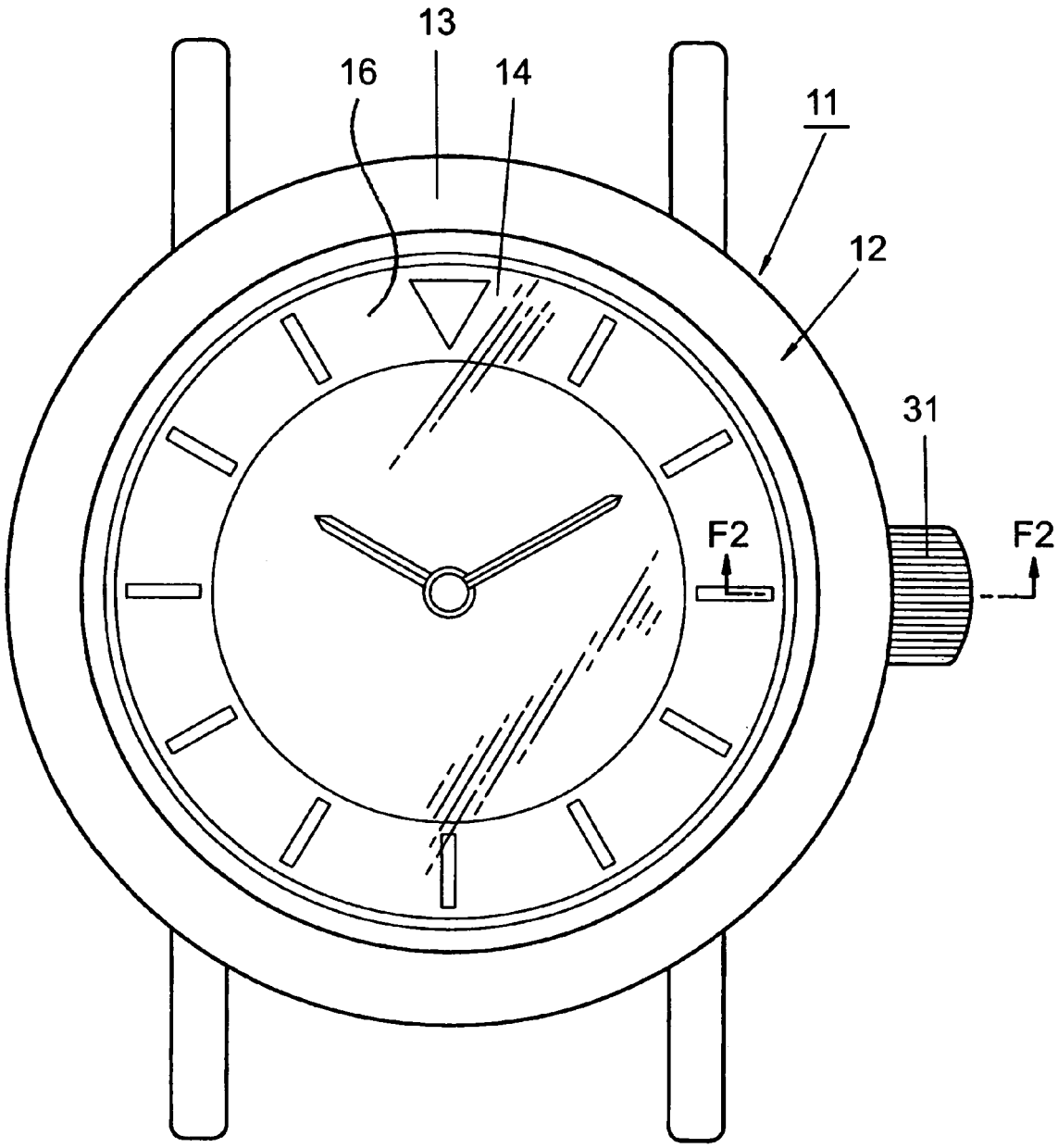
FIG. 1 is a front view of a divers watch according to a first embodiment of the present invention.

A reference numeral 11 in FIG. 1 shows a divers watch as a portable watch with the screw lock structure for a crown. This watch 11 accommodates a watch movement, and the like, that are not shown in a watch exterior assembly 12. The watch movement is not restrictive, and may be the one whose power source is a small-sized battery or a spring, the one of a self-winding type, the one equipped for a digital watch displaying time or others in digital form on a dial by quartz oscillator module, or the one as a result of combining the one equipped for a digital watch and the one equipped for others.

The watch exterior assembly 12 is so formed that a cover glass 14 is attached to be liquidtight over the surface of a case comprised of an annular metallic case band or body 13, and a case back 15 (refer to FIG. 2) made of metal, and the like, is attached to be liquidtight over the back of the case band 13. A dial 16 and others can be seen through the cover glass 14, and the case back 15 can be removable.

Figure 2:
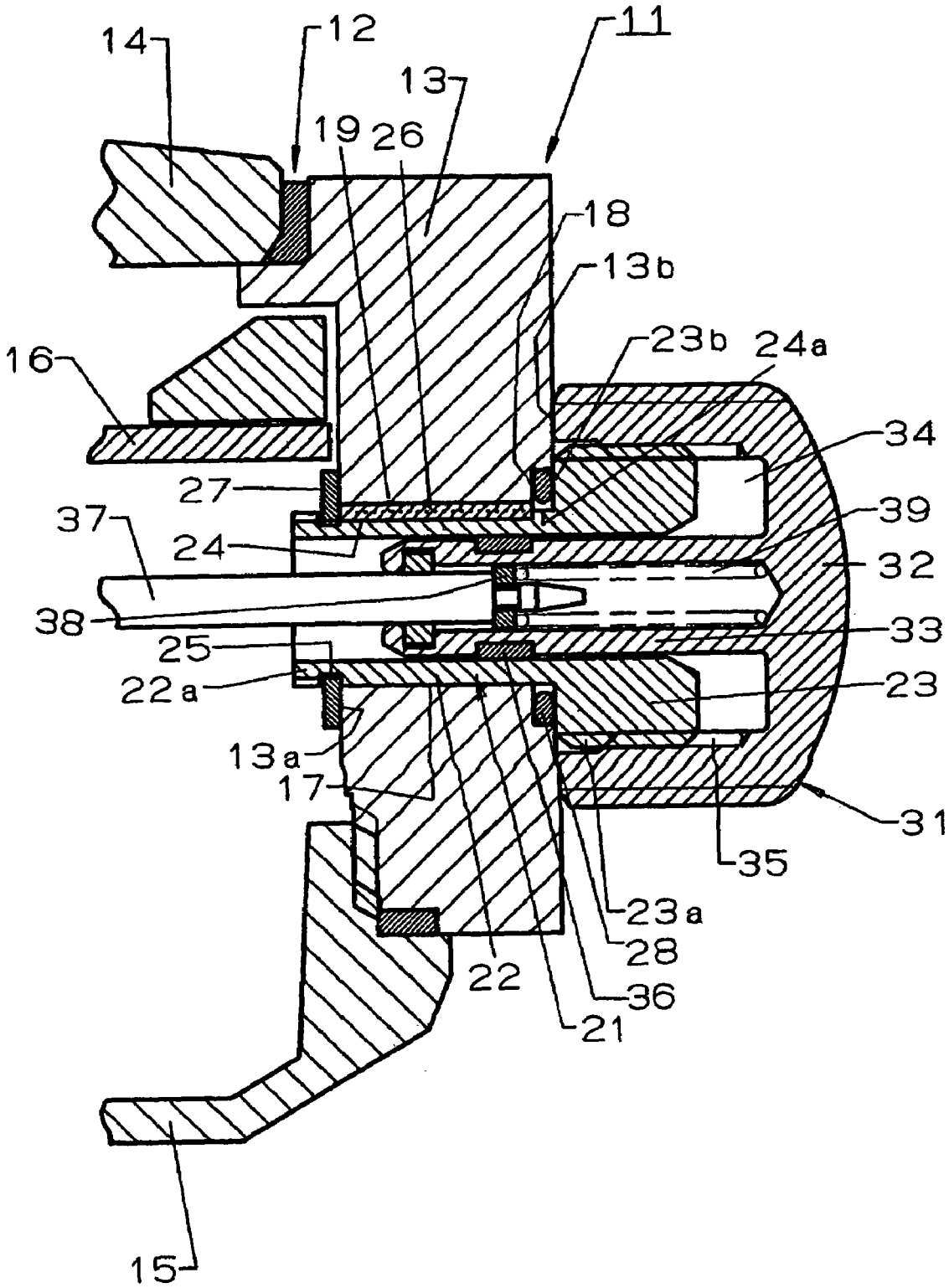
FIG. 2 is a cross-sectional view taken along line F2—F2 in FIG. 1 with a crown screw locked.

As shown in FIG. 2, the case band 13 has, at a part thereof, a pipe-attachment hole 17 extending through the case band 13 in the radius direction. One end of the pipe-attachment hole 17 is made open to the inner or intracase-band side, that is, an intracase-band plane 13*a* facing to the inner space of the watch exterior assembly 12. The other end of the pipe-attachment hole 17 is made open to the outer or extracase-band side, that is, an extracase-band plane 13*b* facing to the outside of the watch exterior assembly 12. The extracase-band plane 13*b* of the case band 13 includes a circular concave section 18. This concave section 18 is made larger in diameter than the pipe-attachment hole 17, and extends through the opening made on the extracase-band side of the hole 17 and is provided concentrically with the opening.

Further, the case band 13 is provided with a pin-receiving groove 19 in parallel to the pipe-attachment hole 17. The pin-receiving groove 19 is made open toward the pipe-attachment hole 17, and formed with one and the other ends thereof opening toward the intracase-band plane 13*a* and the concave section 18 of the extracase-band plane 13*b*, respectively.

Figure 3:
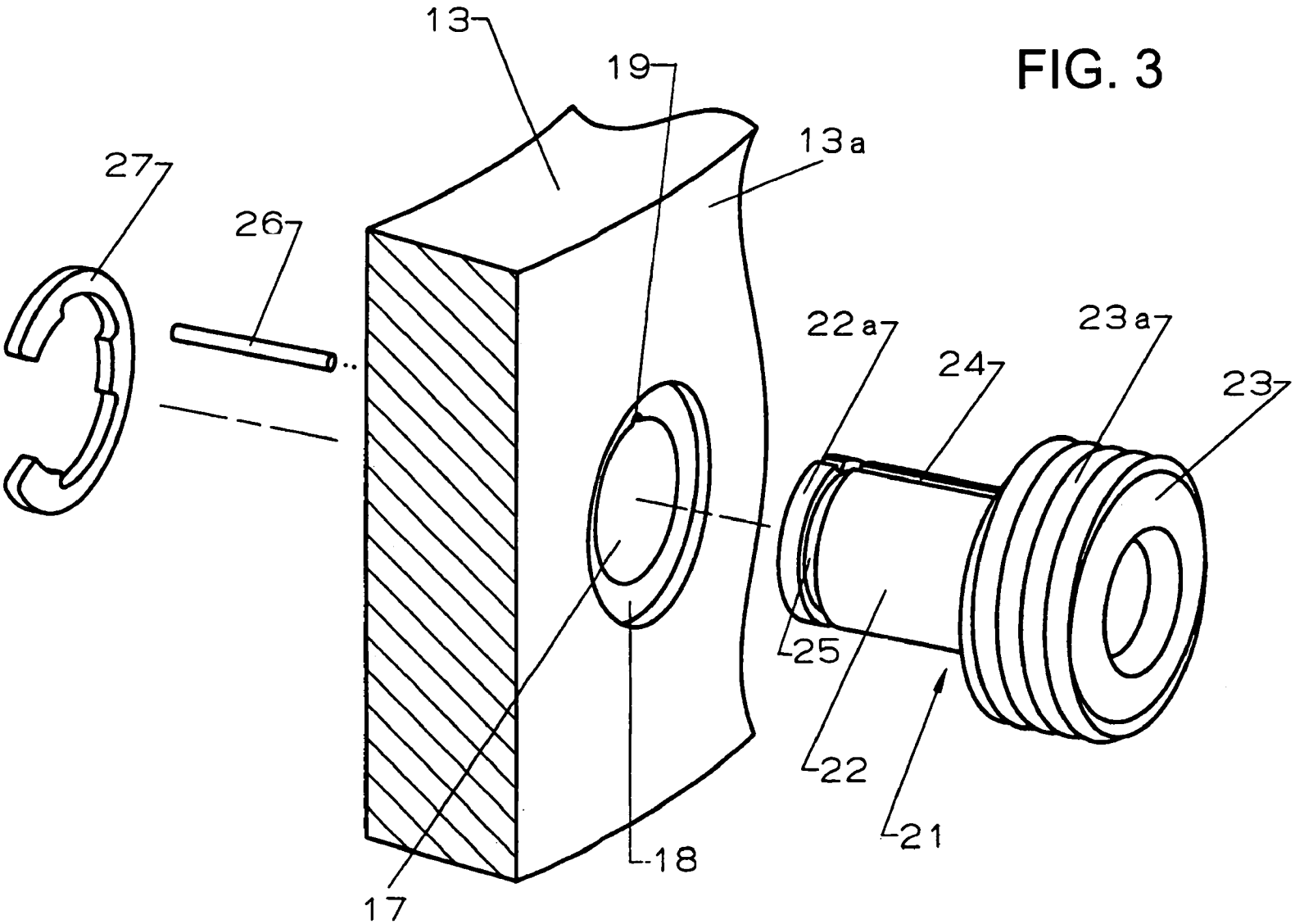
FIG. 3 is a perspective view showing a band case, a winding stem pipe, a rotation-stop pin, and a pipe stopper of the divers watch of FIG. 1, all of which are disassembled from each other.

A reference numeral 21 in FIGS. 2 and 3 denotes a metallic winding stem pipe. This pipe 21 goes through the pipe-attachment hole 17, and attached to the case band 13 in a removal manner from the extracase-band side.

In detail, the winding stem pipe 21 is provided with an insertion section 22 to be playably inserted into the pipe-attachment hole 17, an extracase-band end section 23 to be arranged on the extracase-band side, and a pin-receiving groove 24 formed on the insertion section 22.

The outer diameter of the insertion section 22 is made to be slightly smaller than that of the pipe-attachment hole 17. Thereby, between the pipe-attachment hole 17 and the insertion section 22, play for enabling insertion or removal of the insertion section 22 to/from the pipe-attachment hole 17, that is, a slight gap (not shown) is made. The tip section of the insertion section 22 located farthest from the extracase-band end section 23 forms an intracase-band end section 22*a*. The insertion section 22 is long enough that the intracase-band end section 22*a* protrudes to the inner space of the case band 13 (inside of the case band) at the time when the winding stem pipe 21 is fully inserted in the extracase-band end section 23 in the axial direction.

The extracase-band end section 23 is provided at the other end of the insertion section 22 from the intracase-band end section 22*a*. The extracase-band end section 23 is made larger in diameter than the concave section 18, and at the outer rim plane thereof, formed is a male screw section 23*a*. The plane of the extracase-band end section 23 located closer to the insertion section 22 is orthogonal to the direction of the axial line of the winding stem pipe 21, and is to be used as an abutment plane 23*b* abutting to the extracase-band plane 13*b*.

To the base of the intracase-band end section 22*a* of the insertion section 22, that is, the part of the intracase-band end section 22*a* located closer to the intracase-band plane 13*a* which is the part protruding to the intracase-band side from the case band 13, formed is, for example, an annular engagement groove 25 opening toward the outer rim plane of this end section 22*a*.

The pin-receiving groove 24 is provided by extending in the axial direction of the insertion section 22, and opens toward the outer rim plane of the insertion section 22. The pin-receiving groove 24 is formed to cross the engagement groove 25 as shown in FIG. 3, and opens toward the tip plane of the insertion section 22 facing to the intracase-band side. The pin-receiving groove 24 is so made as to correspond to the pin-receiving groove 19 of the caseband 13, and the two grooves 19 and 24, when opposed to one another, to form a circular hole, for example, opposing to the pin-receiving groove 19. Note herein that, a reference numeral 24*a* in FIG. 2 shows the groove end of the pin-receiving groove 24 closer to the extracase-band end section 23.

The winding stem pipe 21 inserted into the pipe-attachment hole 17 is fixed to the case band 13 using a rotation-stop pin 26 not to rotate. This pin 26 is located across both pin-receiving grooves 19 and 24 by being inserted into the circular hole formed by the pin-receiving grooves 19 and 24 from the intracase-band side, for example. And it operates as a rotation stopper for preventing the winding stem pipe 21 from rotating in the circumferential direction against the case band 13.

The engagement groove 25 is engaged with a pipe stopper 27 such as an E-shaped stopper in a removable manner. The pipe stopper 27 abuts to the intracase-band plane 13*a*, and operates to prevent the winding stem pipe 21 from being disengaged from the pipe-attachment hole 17 toward the extracase-band side. The pipe stopper 27 sandwiches, from the case band 13 both inside and outside, the pipe-attachment hole 17 and therearound with the extracase-band end section 23, and attaches the winding stem pipe 21 to the case band 13. Further, the pipe stopper 27 sandwiches, in the axial direction, the rotation-stop pin 26 with the groove end 24*a* of the pin-receiving groove 24. As such, using the pipe stopper 27 and the groove end 24*a* of the pin-receiving groove 24, the rotation-stop pin 26 is fixed to its predetermined position to prevent disengagement. Thus, there is no need to include any component specifically designed therefor.

A reference numeral 28 in FIG. 2 denotes an annular waterproof rubber gasket. This gasket 28 is fit in the concave section 18, and is sandwiched between the furthest plane of the concave section 18 and the abutment plane 23*b* of the extracase-band end section 23 by changing in shape due to its elasticity through compression, for the purpose of achieving a waterproof or watertight seal between the case band 13 and the winding stem pipe 21.

The winding stem pipe 21 is attached to the case band 13 in the following procedure. First, with the waterproof gasket 28 fit into the concave section 18, or with the outer rim of the insertion section 22 of the winding stem pipe 21 fit with the waterproof gasket 28, the case band 13 and the pin-receiving grooves 19 and 24 of the winding stem pipe 21 are so positioned as to face to one another, the insertion section 22 is inserted and goes through the pipe-attachment hole 17 from the extracase-band side. Insertion of the insertion section 22 into the pipe-attachment hole 17 is restricted by the abutment plane 23*b* of the extracase-band end section 23 abutting to the extracase-band plane 13*b*. At the same time, the engagement groove 25 of the intracase-band end section 22*a* is positioned at any appropriate position with respect to the intracase-band plane 13*a*. Responding to completion of such insertion, the waterproof gasket 28 so far free to move is compressed, and the intracase-band end section 22*a* of the insertion section 22 protrudes to the inside of the case band 13 (inner space of the case band 13).

Next, using as a guide the pin-receiving groove 24 opening toward the tip plane of the intracase-band end section 22*a*, the rotation-stop pin 26 is inserted from the intracase-band side into a hole made by the groove 24 and the pin-receiving groove 19 of the case band 13. Thus the inserted rotation-stop pin 26 engages in both the pin-receiving grooves 19 and 24. In this manner, via the rotation-stop pin 26, the winding stem pipe 21 is prevented from rotating relative to the case band 13.

Thereafter, the pipe stopper 27 is fit into the engagement groove 25 of the intracase-band end section 22*a* while making it along the intracase-band plane 13*a*. As a result, thanks to the pipe-stopper 27 operating to stop disengagement, the winding stem pipe 21 is so retained as not to disengage with the case band 13 toward the extracase-band plane.

With the above procedure, the winding stem pipe 21 is completely attached to the case band 13. Here, alternatively, instead of inserting the rotation-stop pin 26 from the intracase-band side, the winding stem pipe 21 may be attached to the case band 13 by inserting, from the extracase-band side, this pin 26 to the pipe-attachment hole 17 and the pin-receiving groove 19 together with the insertion section 22 with the rotation-stop pin 26 fit with the pin-receiving groove 24 for retention. Then, the insertion section 22 may be attached with the pipe stopper 27 in the intracase-band side.

FIG. 2 shows the state of the case band 13 being attached with the winding stem pipe 21. In this state, the winding stem pipe 21 is biased toward the extracase-band side by the elasticity of the compressed waterproof gasket 28. And the extracase-band end section 23 abutting to the extracase-band plane l3*b*, and the pipe stopper 27 abutting to the intracase-band plane l3*a*, sandwich the pipe-attachment hole 17 and therearound from inside and outside of the case band 13. Thus, the winding stem pipe 21 is attached to the case band 13 in the axial direction with no rattle. Further, the winding stem pipe 21 engages with the case band 13 by the rotation-stop pin 26 so as not to rotate as described in the foregoing. Accordingly, the winding stem pipe 21 is attached to the case band 13 without brazing or using adhesive.

Therefore, the winding stem pipe 21 can be removed from the case band 13 at the time of maintenance, and the like, with the reverse manner to the assembly procedure described above. To perform removal as such, with the case back 15 removed, the pipe stopper 27 in the intracase-band side is first removed, and then the winding stem pipe 21 playably inserted to the pipe-attachment hole 17 is pulled out to the extracase-band side.

A crown denoted by a reference numeral 31 in FIG. 1 is made of metal, and as shown in FIG. 2, is provided with a crown main section 32 and a crown tube section 33 extending in its entirety in the axial direction from the middle section thereof. To the crown main section 32, an annular clearance groove 34 is provided to enclose the base section of the crown tube section 33. And a female screw section 35 is formed to the inner rim plane of the groove 34 for screw locking. The clearance groove 34 is a part into which extends the extracase-band end section 23 of the winding stem pipe 21. The female screw section 35 is screwed together with the male screw section 23*a* of the extracase-band end section 23 in a removable manner. Through such screwing, exerted is the capability for screw lock not to allow the crown 31 to accidentally rotate when the watch 11 is carried around.

The crown tube section 33 is inserted into the winding stem pipe 21 from the extracase-band side. To an annular gasket attachment groove formed to the outer rim of the tube section 33, an annular waterproof rubber gasket 36 is attached. The waterproof gasket 36 is sandwiched between the inner rim plane of the winding stem pipe 21 and the outer rim plane of the crown tube section 33 by changing in shape due to its elasticity through compression, for the purpose of achieving a waterproof seal therebetween. The crown tube section 33 is inserted with a winding stem 37 of the watch movement from the intracase-band side, and accommodates a coil spring 39 that biases the winding stem 37 in the axial direction via a spring bearing 38. The watch movement rotates in relation with the rotation operation of the crown 31 when the female screw section 35 is disengaged from the second male screw section 23*a*, in other words, with screw lock released. In such a manner, time adjustment and other functions can be carried out.

Herein, as to the crown 31, the crown tube section 33 thereof is inserted into the winding stem pipe 21 from the extracase-band side with the winding stem 37 connected thereto, and the female screw section 35 of the crown main section 32 is screwed and clamped with the male screw section 23*a* of the winding stem pipe 21. In this manner, attachment is done. When the crown 31 is screwed into the male screw section 28 to the furthest point, the crown main section 32 is defined by position when abutting to the extracase-band plane 13*b* of the case band 13 as shown in FIG. 2 so that the extracase-band end section 23 is entirely covered. Here, after such a procedure is through, the winding stem 37 and the watch movement are connected together.

With such assembly completed, the waterproof capability can be exerted and retained during use of the portable watch. That, is, waterproof between the winding stem pipe 21 and the case band 13 can be secured due to the waterproof gasket 28 sandwiched therebetween by changing in shape due to its elasticity through compression. Further, waterproof between the winding stem pipe 21 and the crown tube section 33 internally inserted thereinto can be secured due to the waterproof gasket 36 sandwiched therebetween by changing in shape due to its elasticity through compression.

In the divers watch 11 assembled as shown in FIG. 2, the crown 31 is engaged with the male screw section 23*a* of the extracase-band end section 23 of the winding stem pipe 21 for screw locking. This prevents the crown 31 from accidentally rotating when carried around, whereby time display and others do not change. For time adjustment, for example, the crown 31 is rotated in the reverse direction so as to disengage the crown main section 32 from the extracase-band end section 23. Thus, for the purpose, the crown 31 is pulled out against the spring forces of the coil spring 39.

Responding to the operation of the crown 31, if the screw lock capability of the crown 31 is reduced due to damage or wear-out of the male screw section 28 and the female screw section 35 screwed thereinto, it can be dealt with as follows.

In detail, with the crown 31 removed, by removing the pipe stopper 27 as described hereinabove from the engagement groove 25 of the intracase-band end section 22*a* of the winding stem pipe 21, the winding stem pipe 21 playably inserted into the case band 13 without fixation can be pulled out or withdrawn from the extracase-band side along the axial direction.

Accordingly, at the time of maintenance, if the winding stem pipe 21 and the crown 31 are needed to be exchanged, the winding stem pipe 21 and the crown 31 can be separately exchanged. Thanks thereto, for a person asking for repairment, there is no need to exchange the watch exterior assembly 12 including the case band 13, and the like. And, only component exchange will do, favorably reducing the cost payment. Moreover, irrespective of whether exchange of the winding stem pipe 21 is required or not, at the time of maintenance, to clean the case band 13 by polishing the extracase-band plane 13*b* by buffing, for example, the winding stem pipe 21 and other parts can be removed easily. Thus, the extracase-band end section 23 thereof will be kept out of the way during the polishing operation. As such, the polishing operation can be smoothly done, and the extracase-band plane 13*b* can be polished with reliability.

Moreover, in the assembly state, the pipe-attachment hole 17 and therearound of the case band 13 are sandwiched from inside and outside by the pipe stopper 27 attached to the winding stem pipe 21 and the extracase-band end section 23 of the winding stem pipe 21. With such a structure, even if the portable watch 11 receives any impact when accidentally dropped, for example, the winding stem pipe 21 does not rattle against the case band 13.

Further, at the time of attachment of the winding stem pipe 21 to the case band 13 in the above-described manner, there is no need to screw thereinto the winding stem pipe 21, thereby suppressing stress application due to attachment of the winding stem pipe 21 to the case band 13. Therefore, the strength required for the winding stem pipe 21 and others can be reduced, and at the same time, the design flexibility such as material and thickness of the winding stem pipe 21 can be increased. What is better, the process of forming the pin-receiving groove 19 to the winding stem pipe 21 is easier than the process of forming a screw section, and does not need a process for a male screw section corresponding to the winding stem pipe 21, and a process for a female screw section corresponding to the pipe-attachment hole 17. As such, the process cost can be reduced.

Here, in the first embodiment, the pin-receiving groove 19 of the case band 13 opening toward the pipe-attachment hole 17 may be in such a structure that one end opens toward the intracase-band plane 13*a* and the other end is closed, or in such a structure that one end opens toward the extracase-band plane 13*b* and the other end is closed.

Figure 4:
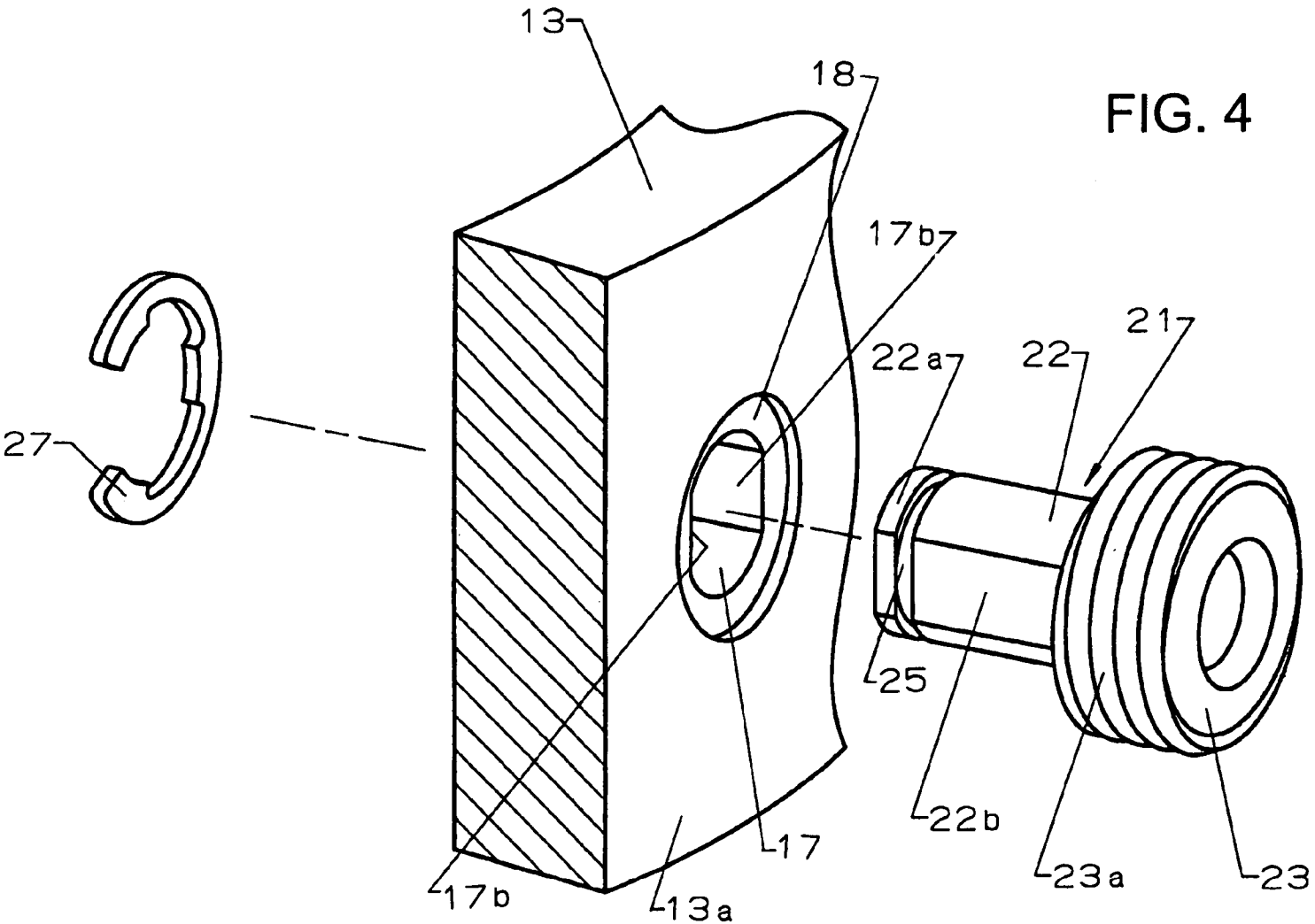
FIG. 4 is a perspective view showing a band case, a winding stem pipe, and a pipe stopper of a divers watch according to a second embodiment of the present invention, all of which are disassembled from each other.

FIG. 4 shows a second embodiment of the present invention. The second embodiment is basically the same as the first embodiment, and thus any identical part to that of the first embodiment is provided with the same reference numeral, and not described again. Described are only parts different from the first embodiment.

In the second embodiment, instead of the pin-receiving groove and the rotation-stop pin for preventing rotation adopted in the first embodiment, the pipe-attachment hole 17 and the insertion section 22 of the winding stem pipe 21 to be playably inserted thereinto are both formed noncircular.

As an example of noncircular shape, the pipe-attachment hole 17 is provided with one or more plane or flat sections, more specifically, a pair of plane or flat sections 17*b* facing each other when the winding stem pipe 21 is not inserted into the pipe-attachment hole 17. Also, corresponding to the hole structure, the outer periphery of the insertion section 22 is also provided with another pair of plane or flat sections 22*b* (only one of those is shown). These plane sections 17*b* and 22*b* operate each as a rotation-stop plane to prevent relative rotation between the case 13 and the winding stem pipe 21. As shown in FIG. 4, the two plane or flat sections 17*b* and 22*b* are interconneted by two circular sections.

The structures other than those described above are the same as those of the first embodiment. Thus, also in this second embodiment, the object of the present invention can be successfully solved with the same effects as the first embodiment. Moreover, in the second embodiment, no part is required for preventing the winding stem pipe 21 from rotating against the case band 13, thereby rendering the structure simpler. Further, there is no need to process a groove so as to extend in the axial direction against the pipe-attachment hole 17 and the insertion section 22. It is thus considered preferable in terms of cost reduction.

The present invention is not restrictive restricted to the above both embodiments. For example, it can be applied to portable watches such as normal wrist watches or pocket watches that do not require waterproof capability under extreme conditions.

According to the present invention, a winding stem pipe playably inserted into a pipe-attachment hole of a case band without being fixed is prevented from rotating using a rotation-stop pin, and is prevented from being disengaged using a pipe stopper. Accordingly, at the time of maintenance, the pipe stopper is removed and the winding stem pipe can be pulled out toward the extracase-band side. Thus, in a case when the screw rock capability is reduced responding to the operation of the crown, provided is a portable watch achieving component exchange of a crown and therearond, that is, the crown and the winding stem pipe for screw rock it can be separately exchanged.

According to the invention in which a pin-receiving groove of a case band is made open toward an intracase-band plane, and another pin-receiving groove of a winding stem pipe is made open toward the tip plane of an insertion section of the winding stem pipe, provided is a portable watch achieving insertion and removal from the intracase-band side without disturbed by the extracase-band end section of the winding stem pipe.

According to the invention in which a groove end of a pin-receiving groove of a winding stem closer to an extracase-band end section and a pipe stopper sandwich a rotation-stop pin in the axial direction, provided is a portable watch not requiring any component specifically designed for not allowing the rotation-stop pin to be disengaged and for retaining it at the predetermined position.

According to the present invention in which a pipe-attachment hole of a case band and an insertion section of a winding stem pipe playably inserted thereto without fixation are both noncircular to prevent a winding stem pipe from rotating, and the winding stem pipe is prevented from being disengaged toward the extracase-band side using a pipe stopper. Thus, at the time of maintenance, it is possible to pull out the winding stem pipe to the extracase-band side after removing the pipe stopper. With such a structure, in a case when the screw rock capability is reduced responding to the operation of the crown, provided is a portable watch achieving component exchange of a crown and therearond, that is, the crown and the winding stem pipe for screw rock it can be separately exchanged.

What is claimed is:

1. A portable watch, comprising:

a case band provided with a pipe-attachment hole opening toward both an intracase-band plane and an extracase-band plane, and a first pin-receiving groove opening toward the pipe-attachment hole and also toward at least either the intracase-band plane or the extracase-band plane;

a winding stem pipe provided with an insertion section inserted into the pipe-attachment hole in a removable manner from outside of the case band and including an intracase-band end section that extends beyond the intracase-band plane to the inside of the case band, an extracase-band end section including a male screw section, and a second pin-receiving groove opening toward an outer rim plane of the insertion section and facing the first pin-receiving groove;

a rotation-stop pin inserted into both the first and second pin-receiving grooves to prevent relative rotation between the case band and the winding stem pipe;

a pipe stopper engaged in a removable manner with an engagement groove that extends circumferentially around the outer periphery of the intracase-band end section to prevent the winding stem pipe from being disengaged from the case band; and a crown including a crown main section formed with a female screw section screwed together with the male screw section in a removable manner.

2. A portable watch according to claim 1; wherein the first pin-receiving groove of the case band is open toward the inside of the case band, and the second pin-receiving groove of the winding stem pipe is open toward the outside of the case band.

3. A portable watch according to claim 1; wherein the rotation-stop pin extends in an axial direction between the pipe stopper and a groove end of the second pin-receiving groove of the winding stem pipe closer to the extracase-band end section.

4. A portable watch, comprising:

a case band provided with a noncircular pipe-attachment hole opening toward both an intracase-band plane and an extracase-band plane;

a winding stem pipe provided with an insertion section having an outer periphery having a noncircular shape that corresponds to the shape of the noncircular pipe-attachment hole and inserted in a removable manner into the pipe-attachment hole from outside of the case band, an intracase-band end section that extends beyond the inside surface of the case band into the interior of the case band, and an extracase-band end section including a male screw section;

a pipe stopper engaged in a removable manner with an engagement groove that extends circumferentially around the outer periphery of the intracase-band end section to prevent the winding stem pipe from being disengaged from the case band; and a crown including a crown main section formed with a female screw section screwed together with the male screw section in a removable manner.

5. A portable watch comprising: a case body having a noncircular pipe-attachment hole extending therethrough; a winding stem pipe removably inserted from outside of the case body into the pipe-attachment hole and having a noncircular outer peripheral portion that cooperates with the noncircular pipe-attachment hole to prevent relative rotation between the case body and the winding stem pipe, an inner end portion that extends beyond the inside surface of the case body into the interior of the case body and an outer end portion that extends out from the exterior of the case body, the outer end portion having a male screw section and the inner end portion having an annular groove around the outer periphery thereof; a stopper removably engaged with the groove and abutting with an interior surface of the case body to prevent withdrawal of the winding stem pipe from the pipe-attachment hole and being disengageable from the groove to permit withdrawal of the winding stem pipe from the pipe-attachment hole; and a crown having a crown main section that has a female screw section screwed together with the male screw section to removably connect the crown to the winding stem pipe.

6. A portable watch according to claim 5; further including an elastically compressible gasket disposed in a compressed state between the case body and the outer end portion of the winding stem pipe to provide a watertight seal between the case body and the winding stem pipe.

7. A portable watch according to claim 6; wherein the case body has a groove on an exterior surface thereof, the gasket being disposed in the groove.

8. A portable watch according to claim 7; wherein the case body groove is an annular groove that surrounds the pipe-attachment hole.

9. A portable watch according to claim 6; wherein the stopper and the gasket are disposed on the interior and exterior surfaces, respectively, of the case body in axial alignment with one another.

10. A portable watch according to claim 6; wherein the noncircular outer peripheral portion of the winding stem pipe and the noncircular pipe-attachment hole have one or more flat sections.

11. A portable watch according to claim 10; wherein the noncircular outer peripheral portion of the winding stem pipe and the noncircular pipe-attachment hole have two opposed flat sections interconnected by two circular sections.

12. A portable watch according to claim 5; wherein the noncircular outer peripheral portion of the winding stem pipe and the noncircular pipe-attachment hole have one or more flat sections.

13. A portable watch according to claim 12; wherein the noncircular outer peripheral portion of the winding stem pipe and the noncircular pipe-attachment hole have two opposed flat sections interconnected by two circular sections.

* * * * *